US011315489B1

(12) United States Patent
Heganovic et al.

(10) Patent No.: US 11,315,489 B1
(45) Date of Patent: Apr. 26, 2022

(54) LIGHT EMITTING DEVICE DRIVING CIRCUIT AND RELATED METHOD

(71) Applicant: SHARP KABUSHIKI KAISHA, Sakai (JP)

(72) Inventors: Adnan Heganovic, Oxford (GB); Kohhei Tanaka, Sakai (JP); Ryo Yonebayashi, Sakai (JP); Masahito Sano, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/233,877

(22) Filed: Apr. 19, 2021

(51) Int. Cl.
*G09G 3/3233* (2016.01)
*G09G 3/3283* (2016.01)

(52) U.S. Cl.
CPC ..... *G09G 3/3233* (2013.01); *G09G 3/3283* (2013.01); *G09G 2300/0819* (2013.01); *G09G 2310/061* (2013.01); *G09G 2320/045* (2013.01)

(58) Field of Classification Search
CPC ..... G09G 3/3233; G09G 3/3283; G09G 2300/0819; G09G 2310/061; G09G 2320/045
See application file for complete search history.

(56) References Cited

U.S. PATENT DOCUMENTS

| | | | | |
|---|---|---|---|---|
| 7,414,599 | B2 | 8/2008 | Chung et al. | |
| 11,004,385 | B1 * | 5/2021 | Li | G09G 3/3233 |
| 2019/0066598 | A1 * | 2/2019 | Kim | G09G 3/3258 |
| 2021/0256908 | A1 * | 8/2021 | Park | G09G 3/3266 |

* cited by examiner

*Primary Examiner* — Jimmy H Nguyen
(74) *Attorney, Agent, or Firm* — ScienBiziP, P.C.

(57) ABSTRACT

A pixel circuit includes a drive transistor configured to control an amount of current to a light emitting device during an emission phase depending upon a voltage applied to a control terminal of the drive transistor, the drive transistor having a first terminal and a second terminal. During a first phase, an anode of the light emitting device is set to a reference voltage and the first terminal of the drive transistor is set to a fixed data voltage such that the drive transistor is stressed with a fixed source-to-gate voltage to prevent a drift of a threshold voltage in the drive transistor thereby preventing a drift in screen brightness. During a second phase, the anode of the light emitting device is set to the reference voltage and the first terminal of the drive transistor is set to a voltage of the first power supply.

19 Claims, 5 Drawing Sheets

LIGHT EMITTING DEVICE DRIVING CIRCUIT AND RELATED METHOD

FIELD

The present disclosure is related to design and operation of electronic circuits for delivering electrical current to an element in a display device, such as for example to an organic light-emitting diode (OLED) in the pixel of an active matrix OLED (AMOLED) display device.

BACKGROUND

Organic light-emitting diodes (OLED) generate light by re-combination of electrons and holes, and emit light when a bias is applied between an anode and a cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, $V_{DAT}$, to be stored at a storage capacitor during a programming phase. When the SCAN signal is high and the switch transistors isolate the circuit from the data voltage, the $V_{DATA}$ voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2, \qquad \text{Equation (1)}$$

where $V_{DD}$ is a power supply connected to the source of the drive transistor.

TFT device characteristics, especially the TFT threshold voltage $V_{TH}$, may vary with time or among comparable devices, for example, due to manufacturing processes or stress and aging of the TFT device over the course of operation. With the same $V_{DATA}$ voltage, therefore, the amount of current delivered by the drive TFT could vary by a significant amount due to such threshold voltage variations. Therefore, pixels in a display may not exhibit uniform brightness for a given $V_{DATA}$ value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is decided by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another drawback of the U.S. Pat. No. 7,414,599 is the voltage variation at VDD line, such as IR drop, will affect the OLED current. At the end of the data programming and compensation phase, the stored voltage across the capacitor is $$V_{DD_{PROG}} - (V_{DAT} - |V_{TH}|) \qquad \text{Equation (2),}$$

where $V_{DD_{PROG}}$ is the VDD voltage during programming and compensation phase, which is applied to a first plate of the storage capacitor; $V_{DAT} - |V_{TH}|$ is the programmed and compensated voltage at a second plate of the storage capacitor.

The IR drop for each pixel on the same SCAN row will be different depending on the programming data voltage. Similarly, the IR drop for pixels on different rows are different, which means the $V_{DD}$ supply voltage $V_{DD_{PROG}}$ during programming will be different. The difference will cause the different OLED currents even with the same data signal and threshold voltage to be compensated. The uniformity of the display will degraded by the IR drop.

SUMMARY

The present disclosure is related to a light emitting device driving circuit and a related method.

In a first aspect of present disclosure, a pixel circuit for a display device comprises a drive transistor configured to control an amount of current to a light-emitting device during an emission phase depending upon a voltage applied to a control terminal of the drive transistor, the drive transistor having a first terminal and a second terminal; a first transistor connected between a reference voltage and the control of the drive transistor; a second switch transistor connected between the second terminal and the control terminal of the drive transistor; a third switch transistor connected between a first power supply and the first terminal of the drive transistor; a fourth switch transistor connected between a data line and the first terminal of the drive transistor; a fifth switch transistor connected between the second terminal of the drive transistor and an anode of the light emitting device; and a sixth switch transistor connected between the anode of the light emitting device and the reference voltage; wherein, during a first phase having a fixed duration, the anode of the light emitting device is set to the reference voltage and the first terminal of the drive transistor is set to a fixed data voltage; and wherein, during a second phase having a variable duration, the anode of the light emitting device is set to the reference voltage and the first terminal of the drive transistor is set to a voltage of the first power supply.

In an implementation of the first aspect, during the first phase, a first emission pulse having a constant pulse width is applied to a control terminal of the sixth transistor to set the anode of the light emitting device to the reference voltage; and during the first phase, a scan pulse is applied to a control terminal of the fourth transistor to set the first terminal of the drive transistor to the fixed data voltage.

In another implementation of the first aspect, during the second phase, a second emission pulse having a variable pulse width is applied to a control terminal of the sixth transistor to set the anode of the light emitting device to the reference voltage, and to control a pulse width modulation (PWM) setting of the display device.

In yet another implementation of the first aspect, during the first phase, the first terminal of the drive transistor is set to a fixed data voltage such that the drive transistor is stressed with a fixed gate-to-source voltage to prevent a drift of a threshold voltage in the drive transistor to prevent a drift in screen brightness of the display device.

In a second aspect of present disclosure, a pixel circuit for a display device comprises: a drive transistor configured to control an amount of current to a light-emitting device during an emission phase depending upon a voltage applied to a control terminal of the drive transistor, the drive transistor having a first terminal and a second terminal; wherein, during a first phase having a fixed duration, an anode of the light emitting device is set to a reference voltage and the first terminal of the drive transistor is set to a fixed data voltage such that the drive transistor is stressed with a fixed source-to-gate voltage to prevent a drift of a threshold voltage in the drive transistor thereby preventing a drift in screen brightness of the display device; and wherein, during a second phase having a variable duration, the anode of the light emitting device is set to the reference voltage and the first terminal of the drive transistor is set to a voltage of the first power supply.

In an implementation of the second aspect, the pixel circuit further comprises a switch transistor connected between the reference voltage and the control of the drive transistor.

In another implementation of the second aspect, the pixel circuit further comprises a switch transistor connected between the second terminal and the control terminal of the drive transistor.

In yet another implementation of the second aspect, the pixel circuit further comprises a switch transistor connected between a first power supply and the first terminal of the drive transistor.

In yet another implementation of the second aspect, the pixel circuit further comprises a switch transistor connected between a data line and the first terminal of the drive transistor.

In yet another implementation of the second aspect, the pixel circuit further comprises a switch transistor connected between the second terminal of the drive transistor and an anode of the light emitting device.

In yet another implementation of the second aspect, the pixel circuit further comprises a switch transistor connected between the anode of the light emitting device and the reference voltage.

In yet another implementation of the second aspect, during the first phase, a first emission pulse having a constant pulse width is applied to a control terminal of the sixth transistor to set the anode of the light emitting device to the reference voltage, and during the first phase, a scan pulse is applied to a control terminal of the fourth transistor to set the first terminal of the drive transistor to the fixed data voltage.

In yet another implementation of the second aspect, during the second phase, a second emission pulse having a variable pulse width is applied to a control terminal of the sixth transistor to set the anode of the light emitting device to the reference voltage, and to control a pulse width modulation (PWM) setting of the display device.

In a third aspect of present disclosure, a method of operating a pixel circuit for a display device, the method comprises: providing the pixel circuit comprising: a drive transistor configured to control an amount of current to a light-emitting device during an emission phase depending upon a voltage applied to a control terminal of the drive transistor, the drive transistor having a first terminal and a second terminal; a first transistor connected between a reference voltage and the control of the drive transistor; a second switch transistor connected between the second terminal and the control terminal of the drive transistor; a third switch transistor connected between a first power supply and the first terminal of the drive transistor; a fourth switch transistor connected between a data line and the first terminal of the drive transistor; a fifth switch transistor connected between the second terminal of the drive transistor and an anode of the light emitting device; and a sixth switch transistor connected between the anode of the light emitting device and the reference voltage. The method further comprises performing a first phase having a fixed duration, during which the anode of the light emitting device is set to the reference voltage and the first terminal of the drive transistor is set to a fixed data voltage; and performing a second phase having a variable duration, during which the anode of the light emitting device is set to the reference voltage and the first terminal of the drive transistor is set to a voltage of the first power supply.

In an implementation of the third aspect, the first phase is an anode reset and on bias stress phase.

In another implementation of the third aspect, during the anode reset and on bias stress phase, a first emission pulse having a constant pulse width is applied to a control terminal of the sixth transistor to set the anode of the light emitting device to the reference voltage; and during the anode reset and on bias stress phase, a scan pulse is applied to a control terminal of the fourth transistor to set the first terminal of the drive transistor to the fixed data voltage.

In yet another implementation of the third aspect, the second phase is an anode reset only phase.

In yet another implementation of the third aspect, during the anode reset only phase, a second emission pulse having a variable pulse width is applied to a control terminal of the sixth transistor to set the anode of the light emitting device to the reference voltage, and to control a pulse width modulation (PWM) setting of the display device.

In yet another implementation of the third aspect, during the first phase, the first terminal of the drive transistor is set to a fixed data voltage such that the drive transistor is stressed with a fixed gate-to-source voltage to prevent a drift of a threshold voltage in the drive transistor to prevent a drift in screen brightness of the display device.

BRIEF DESCRIPTION OF THE DRAWINGS

Implementations of the present technology will now be described, by way of example only, with reference to the attached figures.

DESCRIPTION

Figure 1:
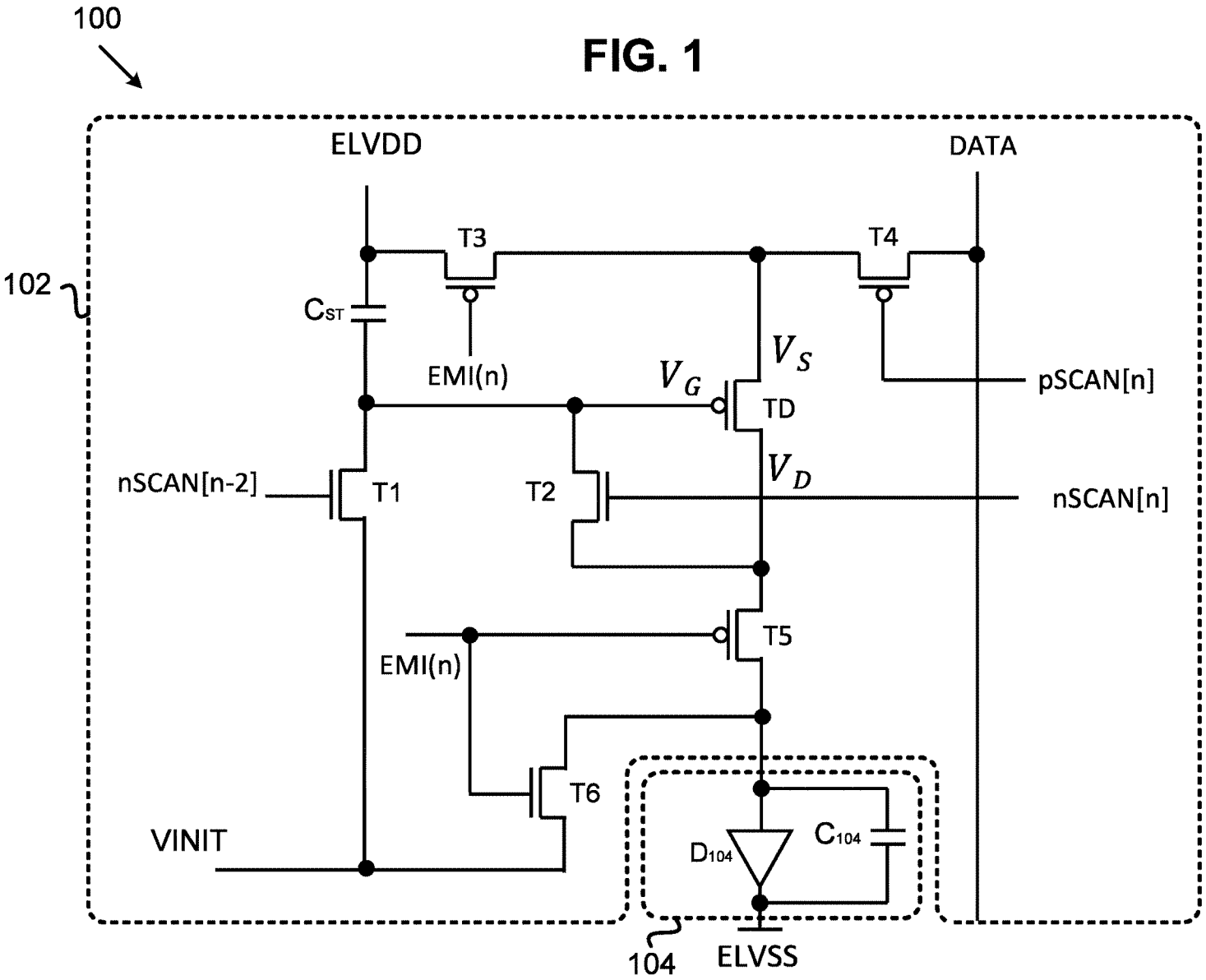
FIG. 1 illustrates a schematic diagram of a circuit for driving a light-emitting device, in accordance with an example implementation of the present disclosure.

The following description contains specific information pertaining to implementations in the present disclosure. The drawings in the present application and their accompanying detailed description are directed to merely exemplary implementations. It will be appreciated that for simplicity and clarity of illustration, where appropriate, reference numerals have been repeated among the different figures to indicate corresponding or analogous elements. In addition, numerous specific details are set forth in order to provide a thorough understanding of the implementations described herein. However, it will be understood by those of ordinary skill in the art that the implementations described herein can be practiced without these specific details. In other instances, methods, procedures, and components have not been described in detail so as not to obscure the related relevant feature being described. Also, the description is not to be considered as limiting the scope of the implementations described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Referring now to FIG. 1, FIG. 1 illustrates a schematic diagram 100 of a driver circuit 102 for driving a light-emitting device 104, in accordance with an example implementation of the present disclosure. In the present implementation, the driver circuit 102 may include transistors $T_1$, $T_2$, $T_3$, $T_4$, $T_5$, and $T_6$. The driver circuit 102 may further include a drive transistor $T_D$ and a storage capacitor $C_{ST}$.

In the present implementation, the transistors $T_1$, $T_2$, and $T_6$, are n-MOS or n-type transistors, and the drive transistor $T_D$ and transistors $T_3$, $T_4$, and $T_5$, are p-MOS or p-type transistors. In one implementation, the driver circuit 102 is configured as a thin film transistor (TFT) circuit to drive the light-emitting device 104. In one implementation, at least one of the transistors $T_1$, $T_2$, $T_3$, $T_4$, $T_5$, and $T_6$ and the drive transistor $T_D$ is a TFT. In one implementation, the drive transistor may be an analogue TFT, while the transistors $T_1$, $T_2$, $T_3$, $T_4$, $T_5$, and $T_6$ are digital switch TFTs.

In the present implementation, the light-emitting device 104 may include a light-emitting diode $D_{104}$ (e.g., an OLED). The light-emitting device 104 may also include an associated internal capacitance, which is represented as $C_{104}$ in the circuit diagram 100. The $C_{104}$ is not a separate component, but is inherent to the light-emitting device 104.

It should be understood that, although the implementations are described principally in connection with an OLED as the light-emitting device, comparable principles may be used with display technologies that employ other types of light-emitting devices, including for example micro LEDs and quantum dot LEDs.

The drive circuit 102 and the light-emitting device 104, including the transistors, capacitors and connecting wires, may be fabricated using TFT fabrication processes known in the art. It will be appreciated that comparable fabrication processes may be employed to fabricate the TFT circuits according to any of the implementations.

For example, the drive circuit 102 and other implementations may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g., SCAN, EMI, $V_{DAT}$ and $V_{REF}$) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The light emitting device 104 may be disposed over the drive circuit 102. The light emitting device 104 may comprise a first electrode (e.g., an anode of the OLED), which is connected to transistors $T_5$ and $T_6$ in the present implementation, one or more layers for injecting or transporting charge (e.g., holes) to an emission layer, an emission layer, one or more layers for injecting or transporting electrical charge (e.g., electrons) to the emission layer, and a second electrode (e.g., a cathode of the OLED), which is connected to power supply ELVSS in the present implementation. The injection layers, transport layers and emission layer may be organic materials, the first and second electrodes may be metals, and all of these layers may be deposited by a thermal evaporation technique, for example.

Figure 2A:
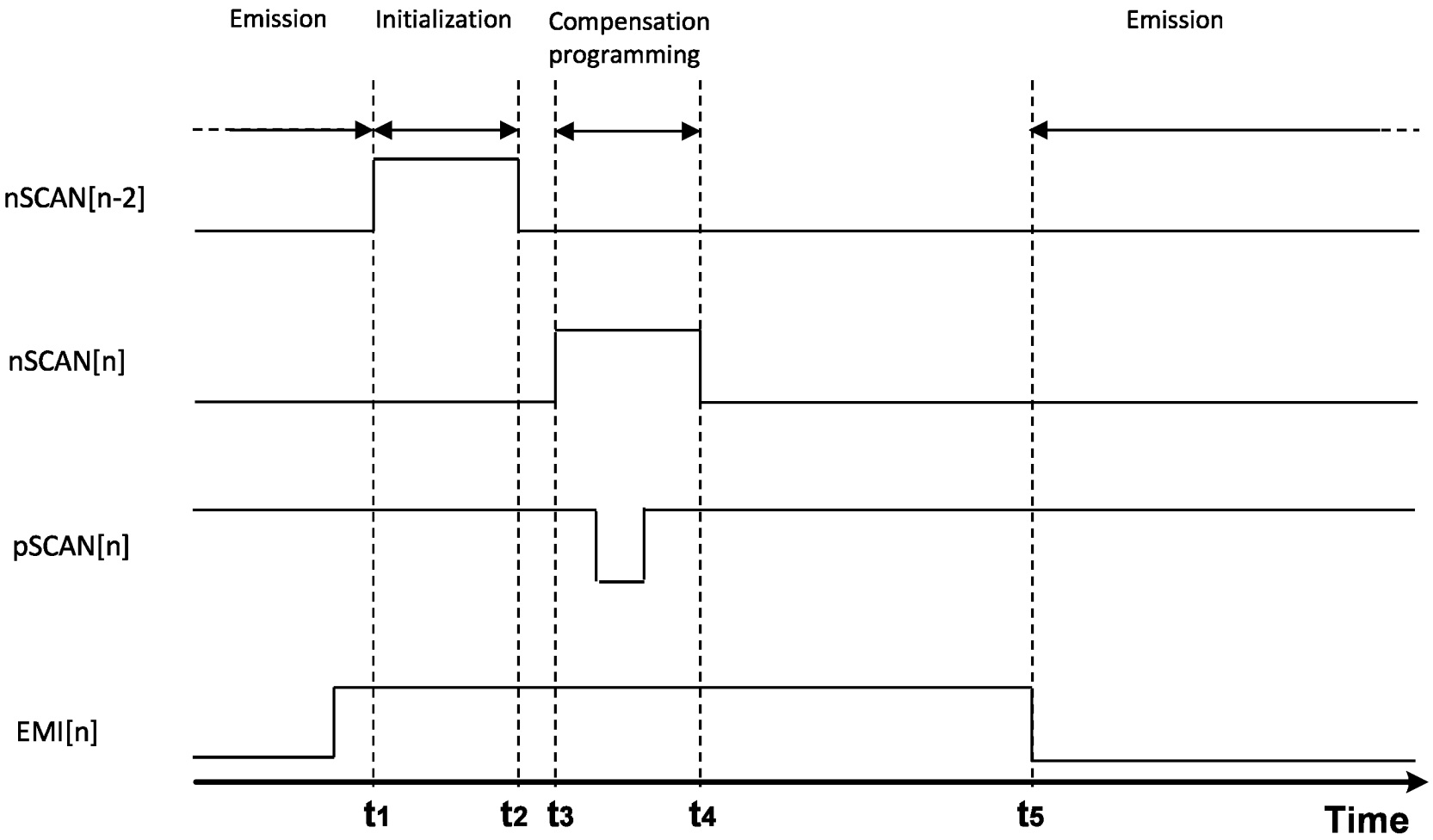
FIG. 2A illustrates a timing diagram associated with the operation of the pixel driving circuit of FIG. 1 during a refresh frame, in accordance with an example implementation of the present disclosure.

FIG. 2A is a timing diagram associated with the operation of the driver circuit of FIG. 1 in a refresh mode having three phases: an initialization phase (e.g., from $t=t_1$ to $t=t_2$), a compensation and data programming phase (e.g., from $t=t_3$ to $t=t_4$), and an emission phase for light emission (e.g., beginning at $t=t_5$). The time period for performing the programming phase is referred to as a "one horizontal time" or "1H" time as illustrated in the timing diagram and in the subsequent timing diagrams.

In various implementations of the present disclosure, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n+1) refers to the scan signal at row n+1, and the like. EMI(n) refers to the emission signal at row n and EMI(n−1) refers to the emission signal at row n−1, and the like, and so on for the various control signals. In this manner, for the various embodiments the input signals correspond to the indicated rows.

In the present implementation, during the previous emission phase (e.g., before $t=t_1$), the EMI(n) has a low voltage value, so the transistors $T_3$ and $T_5$ are on, and the transistor $T_6$ is off, and light emission is being driven by the input driving voltage $V_{DD}$ connected to the drive transistor $T_D$, whereby the actual current applied to the light emitting device 104 is determined by the voltage between the gate and the source of the drive transistor $T_D$.

During the previous emission phase, the nSCAN signal levels for the applicable rows initially have a low voltage value so that the transistors $T_1$ and $T_2$ are in an off state. The p SCAN signal level for the applicable rows initially has a high voltage value so that the transistor $T_4$ is in an off state.

As shown in FIG. 2A, before the beginning of the initialization phase (e.g., before $t=t_1$), the EMI(n) signal level is changed from a low voltage value to a high voltage value, causing the transistors $T_3$ and $T_5$ to be turned off, and the transistor $T_6$ to be turned on. When the transistor $T_6$ is on, the anode of the OLED is reset to $V_{INIT}$. Next, the nSCAN (n−2) signal level is changed from a low voltage value to a high voltage value which turns the transistor $T_1$ on. $V_{INIT}$ is applied to $V_G$ through the transistor $T_1$. The drive transistor $T_D$'s previous gate voltage is therefore reset, and the drive transistor $T_D$ is initialized to a high gate source voltage, which is a required for the next phase, the programming and compensation phase.

At the end of the initialization phase (e.g., at $t=t_2$), the signal nSCAN(n−2) is changed from a high to a low state which turns the transistor $T_1$ off. The signal nSCAN(n) is changed from a low to a high state at the beginning of the compensation and data programming phase (e.g., at $t=t_3$) which turns the transistor $T_2$ on. The gate node $V_G$ and the drain node $V_D$ of the drive transistor $T_D$ are connected through the transistor $T_2$. The source voltage $V_S$ of the drive transistor $T_D$ was set to DATA in the previous phase. The source gate voltage of the drive transistor is now:

$$V_{SG}=V_{DATA}-V_{VINI} \quad \text{Equation (3).}$$

Since the gate node $V_G$ is floating, the drive transistor $T_D$ injects a current into the gate node $V_G$ until the gate voltage value of the drive transistor $T_D$ is high enough to turn off the drive transistor. The voltage on the gate node $V_G$ after compensation is:

$$V_G=V_{DATA}-V_{TH} \quad \text{Equation (4),}$$

where $V_{TH}$ is the threshold voltage of the drive transistor $T_D$.

Preferably, to have effective voltage threshold compensation of the drive transistor $T_D$, the initial voltage difference between the gate and the source of the drive transistor should be:

$$V_{DATA}-V_{VINI}>|V_{TH}|+\Delta V \quad \text{Equation (5),}$$

where ΔV is a voltage that is large enough to generate a high initial current to charge the storage capacitor ($C_{ST}$) within an allocated threshold compensation time. The value of ΔV will depend on the properties of the transistors. For example, ΔV may be at least 3 volts for exemplary IGZO and LTPS thin film transistor processes. The voltages ELVDD and VINI, are set to satisfy this voltage requirement. The anode voltage is set to $V_{DATA}$ through the transistor $T_6$. Therefore the voltage stored on the storage capacitor $C_{st}$ is:

$$V_{C_{ST}}=V_{ELVDD}-V_{DATA}+V_{TH} \quad \text{Equation (6).}$$

Next, during the emission phase, the signal EMI(n) is changed from a high to a low state (e.g., at $t=t_5$), turning the transistors $T_3$ and $T_5$ on, and the transistor $T_6$ off. The drive transistor $T_D$ is now connected to the positive power supply. The gate source voltage of the drive transistor is therefore identical with the voltage stored on the storage capacitor $C_{ST}$ and is:

$$V_{SG}=V_{C_{ST}}=V_{ELVDD}-V_{DATA}+V_{TH} \quad \text{Equation (7).}$$

The drive transistor now supplies a current to the light emitting device from the positive to the negative supply rail. The amount of current supplied by the drive transistor $T_D$ is:

$$I_{OLED}=\frac{\beta}{2}(V_{SG}-V_{TH})^2, \quad \text{Equation (8)}$$

$$I_{OLED}=\frac{\beta}{2}(V_{ELVDD}-V_{DATA}+V_{TH}-V_{TH})^2, \quad \text{Equation (9)}$$

$$I_{OLED}=\frac{\beta}{2}(V_{ELVDD}-V_{DATA})^2, \quad \text{Equation (10)}$$

$$\beta=\mu_n\cdot C_{ox}\cdot\frac{W}{L}, \quad \text{Equation (11)}$$

where $C_{ox}$ is the capacitance of the drive transistor gate oxide,

W is the width of the drive transistor channel,

L is the length of the drive transistor channel (i.e. distance between source and drain), and $\mu_n$ is the carrier mobility of the drive transistor.

In some implementations, low leakage transistors, such as IGZO transistors, can be used as the switch transistors connected to respective voltage supply lines. By using low leakage transistors, either a low storage capacitor can be used to reduce the pixel size or a low refresh rate such as 30 Hz or lower can be used to better display static or low motion images. Power consumption thus can be reduced.

Since the pixel circuit 102 in FIG. 1 uses an IGZO and LTPS (LTPO) process, it can operate at much lower frequencies than a conventional LTPS circuit. This is made possible by the properties of IGZO switch TFT transistors, which show a very low leakage current. The extremely low current leakage of the indium gallium zinc oxide (IGZO) transistors allows storing the charge on the storage capacitor Cst for a much longer period of time and hence enables very low refresh rate such as 1 Hz.

Figure 2B:
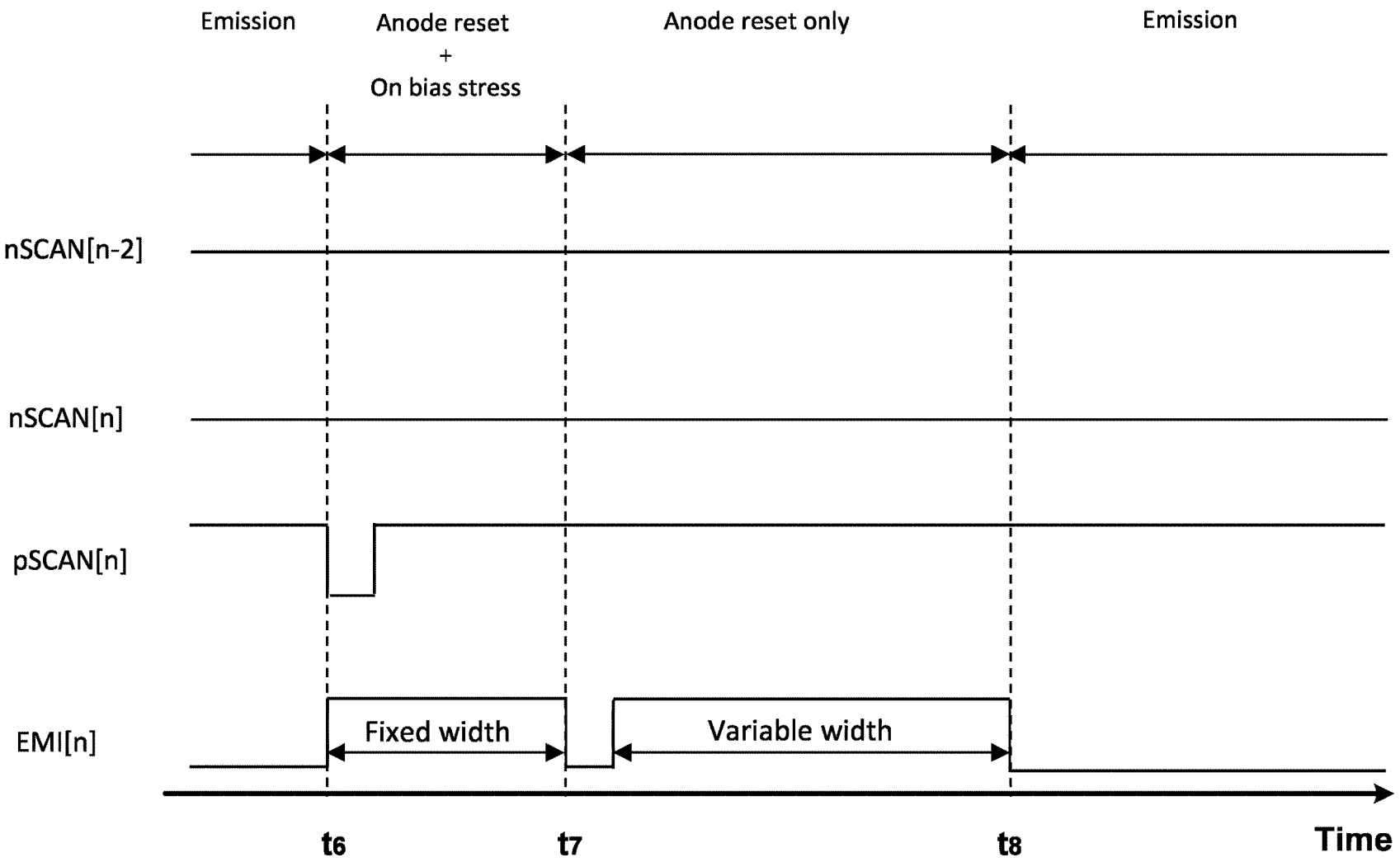
FIG. 2B illustrates a timing diagram associated with the operation of the pixel driving circuit of FIG. 1 during a non-refresh frame, in accordance with an example implementation of the present disclosure.

Referring to FIG. 2B, FIG. 2B is a timing diagram associated with the operation of the driver circuit of FIG. 1 in a non-refresh mode having two phases: an anode reset and on bias stress phase (e.g., from $t=t_6$ to $t=t_7$), and an anode reset only phase (e.g., from $t=t_7$ to $t=t_8$).

During the previous emission phase, the EMI(n) has a low voltage value, so the transistors $T_3$ and $T_5$ are on and the transistor $T_6$ is off, and light emission is being driven by the input driving voltage $V_{DD}$ connected to the drive transistor $T_D$, whereby the actual current applied to the OLED is determined by the voltage between the gate and the source of the drive transistor. The nSCAN signal levels for the applicable rows initially have a low voltage value so transistors $T_1$ and $T_2$ are all in an off state. The pSCAN signal level for the applicable rows initially has a high voltage value so the transistor $T_4$ is in an off state.

At the beginning of the anode reset and on bias stress phase (e.g., at $t=t_6$), the EMI(n) signal level is changed from a low voltage value to a high voltage value, causing the transistors $T_3$ and $T_5$ to be turned off, and the transistor $T_6$ to be turned on. When the transistor $T_6$ is on, the anode of the light-emitting device 104 is reset to $V_{INIT}$. The pSCAN (n) signal level is changed from a high voltage value to a low voltage value which turns the transistor $T_4$ on. A high enough data voltage is applied to the source of the drive transistor through the transistor $T_4$ to stress the drive transistor $T_D$. This applied voltage stress resets the threshold voltage of the drive transistor $T_D$ by trapping charge at the oxide-channel interface.

At the beginning of the anode reset only phase (e.g., at $t=t_7$), the EMI(n) signal level is changed from a high voltage value to a low voltage value, causing the transistors $T_3$ and $T_5$ to be turned on, and the transistor $T_6$ to be turned off. The source of the drive transistor $T_D$ is now set to ELVDD. Hence the drive transistor $T_D$ is no longer stressed by the high data voltage. The EMI(n) signal level is changed from a low voltage value to a high voltage value, causing transistors $T_3$ and $T_5$ to be turned off, and the transistor $T_6$ to be turned on. The anode of the light-emitting device 104 is set to $V_{INIT}$.

During the emission phase (e.g., at $t=t_8$), the signal EMI(n) is changed from a high to a low state, turning the transistors $T_3$ and $T_5$ on, and the transistor $T_6$ off. The drive transistor $T_D$ now supplies a current to the light emitting device.

Figure 3:
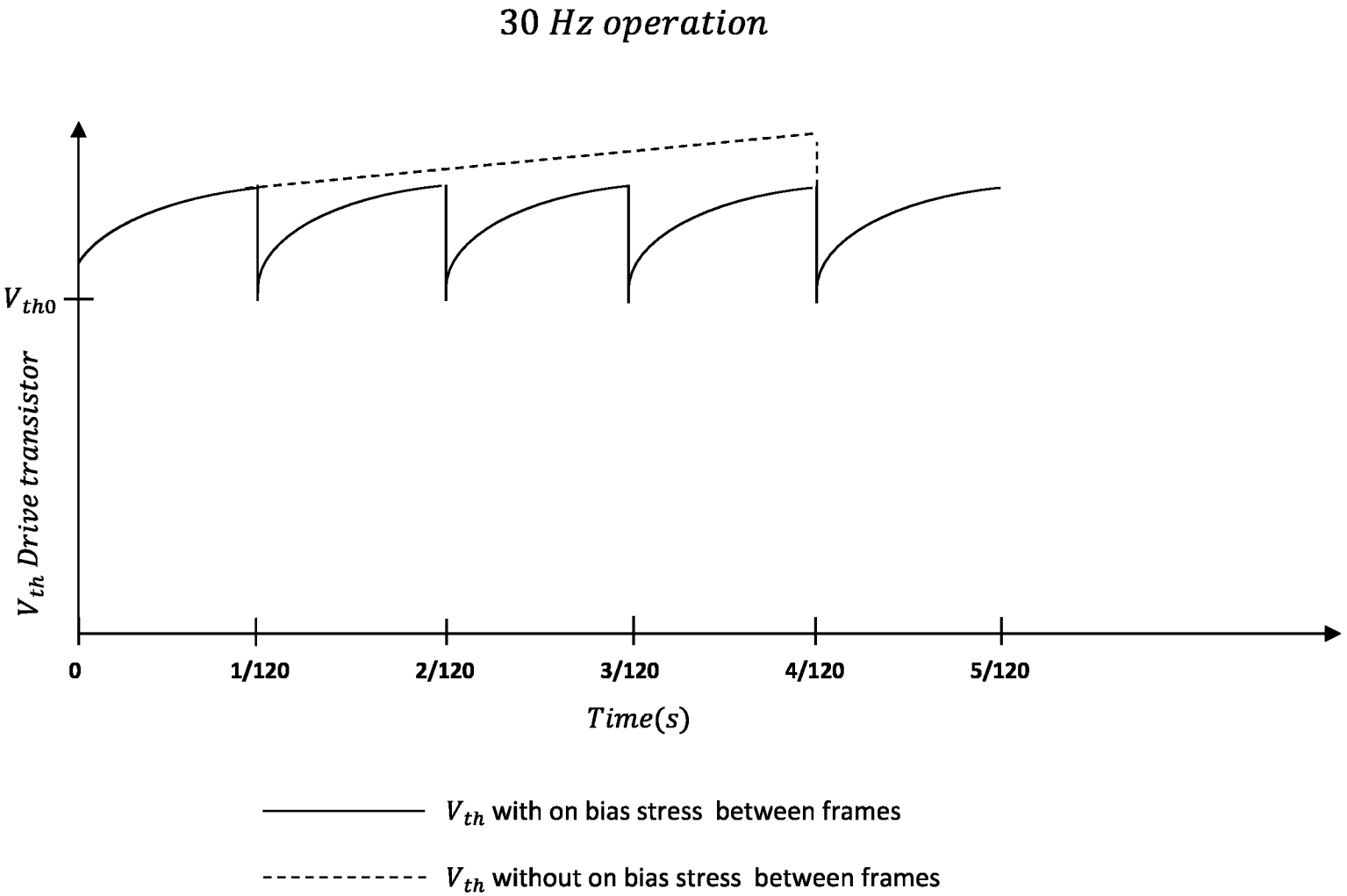
FIG. 3 illustrates the threshold voltage of the drive transistor of the pixel driving circuit of FIG. 1 under on bias stress, in accordance with an example implementation of the present disclosure.

FIG. 3 shows how inserting the on bias stress phase in FIG. 2 between the frames changes the threshold voltage ($V_{TH}$) of the drive transistor $T_D$ in FIG. 1. In the present implementation, it is assumed that the drive circuit 102 operations at 30 Hz.

As illustrated in FIG. 3, the dotted curve shows what the threshold voltage ($V_{TH}$) of the drive transistor $T_D$ would behave without inserting the on bias stress phase between the frames. The threshold voltage ($V_{TH}$) of the drive transistor $T_D$ would drift away from the initial $V_{th}$ ($V_{th0}$) and be reset only when the frame is refreshed. As a result, the amount of current delivered by the drive TFT could vary by a significant amount due to such threshold voltage variations. Therefore, pixels in a display may not exhibit uniform brightness for a given $V_{DATA}$ value.

As illustrated in FIG. 3, the solid curve shows what the threshold voltage $V_{TH}$ of the drive transistor $T_D$ behaves with the on bias stress phase inserted between the frames. The threshold voltage $V_{TH}$ of the drive transistor $T_D$ is reset to the initial $V_{th}$ ($V_{th0}$) during the non-refresh frames. As such, the amount of current delivered by the drive TFT may be better regulated which results in the pixels in a display exhibiting substantially uniform brightness for a given $V_{DATA}$ value.

Moreover, the method of driving where the on bias stress duration as described with reference to FIGS. 1, 2A, 2B, and 3 is independent of the emission width (PMW) setting to ensure that the amount of the drive transistor's threshold reset does not vary with the PMW setting.

Figure 4:
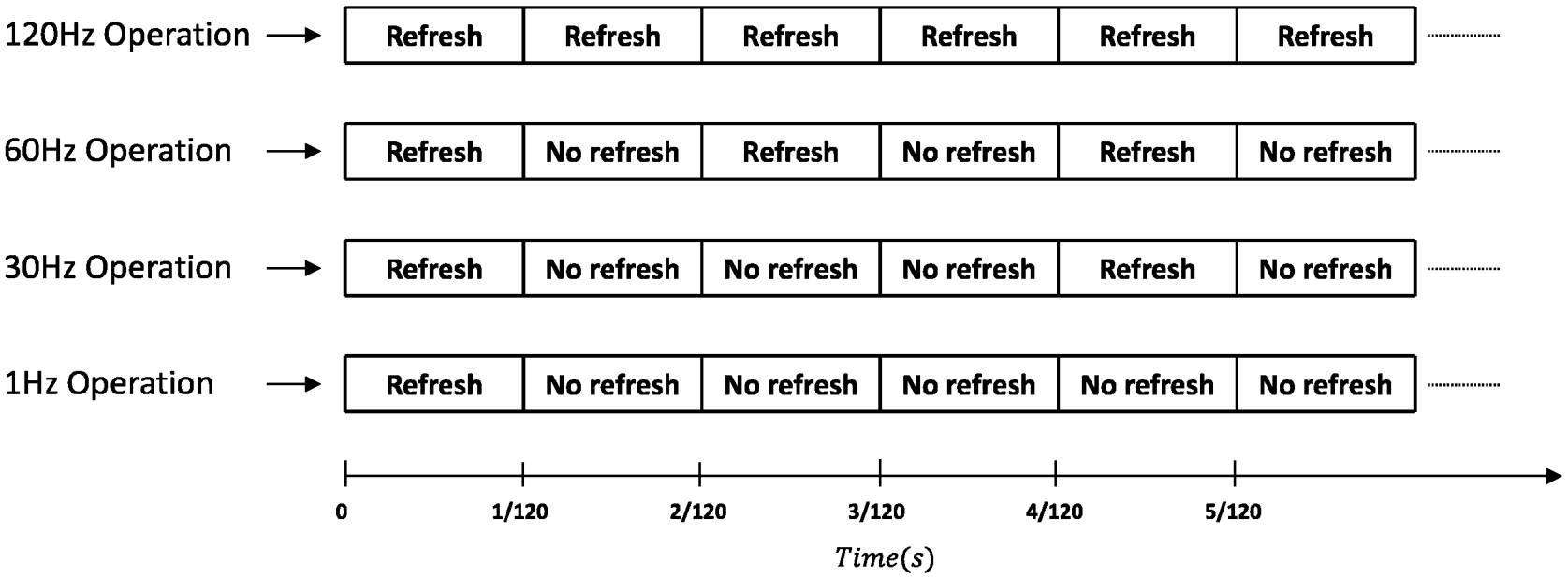
FIG. 4 illustrates different refresh rates of the pixel driving circuit of FIG. 1, in accordance with an example implementation of the present disclosure.

FIG. 4 shows how different refresh rates are achieved. By inserting non-refresh frames, in which the data voltage is not updated, lower refresh rates can be achieved. Therefore, it is preferable to make sure that the refresh and non-refresh frame have the same perceived brightness level. Anode resetting causes a dip in luminance during a refresh frame, hence anode resetting also must occur during a non-refresh frame to match the brightness levels of these two frames.

According to various implementations of the present disclosure, the threshold voltage $V_{TH}$ of the drive transistor $T_D$ is reset regularly via on bias stress to substantially eliminate drifting in threshold voltage. Thus, the brightness levels of a refresh and non-refresh frame are substantially matched with each other thereby substantially eliminating a drift in brightness, especially at low refresh rates (e.g., 1 Hz).

The present disclosure is related to pixel circuits that employ an on bias stress phase during an anode reset to reduce flicker. For low frequency operations such as 1 Hz resetting the anode voltage of the light emitting device is important to ensure constant brightness and therefore avoid flicker. When an anode reset is performed, the drive transistor can be stressed with a fixed gate source voltage to prevent a drift of the threshold voltage in the drive transistor over time, which results in a drift in screen brightness over time. When performing on bias stress, the stress voltage value and the time duration of the application determine the amount of the threshold voltage reset.

Implementations of the present disclosure provide a method of driving where the on bias stress duration is independent of the emission width (PMW) setting to ensure that the amount of the drive transistor's threshold reset does not vary with the PMW setting.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Implementations of the present disclosure are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST $T_1$, $T_2$, $T_3$, $T_4$, $T_5$, and $T_6$—switch transistors;
$T_D$—drive transistor;

OLED—organic light emitting diode (or generally light-emitting device);

$C_{ST}$—storage capacitor;

$C_{104}$—parasitic capacitance of the OLED 104;

$V_G$—gate of drive transistor in the pixel circuit;

$V_S$—source of drive transistor in the pixel circuit;

$V_D$—drain of drive transistor in the pixel circuit;

$V_{DAT}$—data voltage;

ELVSS—power supply;

ELVDD—power supply;

$V_{INI}$—reference voltage supply;

SCAN(n)/EMI(n)—control signals.

What is claimed is:

1. A pixel circuit for a display device, the pixel circuit comprising:

a drive transistor configured to control an amount of current to a light-emitting device during an emission phase depending upon a voltage applied to a control terminal of the drive transistor, the drive transistor having a first terminal and a second terminal;

a first transistor connected between a reference voltage and the control of the drive transistor;

a second switch transistor connected between the second terminal and the control terminal of the drive transistor;

a third switch transistor connected between a first power supply and the first terminal of the drive transistor;

a fourth switch transistor connected between a data line and the first terminal of the drive transistor;

a fifth switch transistor connected between the second terminal of the drive transistor and an anode of the light emitting device; and a sixth switch transistor connected between the anode of the light emitting device and the reference voltage;

wherein, during a first phase having a fixed duration, the anode of the light emitting device is set to the reference voltage and the first terminal of the drive transistor is set to a fixed data voltage; and wherein, during a second phase having a variable duration, the anode of the light emitting device is set to the reference voltage and the first terminal of the drive transistor is set to a voltage of the first power supply.

2. The pixel circuit of claim 1, wherein:

during the first phase, a first emission pulse having a constant pulse width is applied to a control terminal of the sixth transistor to set the anode of the light emitting device to the reference voltage; and during the first phase, a scan pulse is applied to a control terminal of the fourth transistor to set the first terminal of the drive transistor to the fixed data voltage.

3. The pixel circuit of claim 1, wherein:

during the second phase, a second emission pulse having a variable pulse width is applied to a control terminal of the sixth transistor to set the anode of the light emitting device to the reference voltage, and to control a pulse width modulation (PWM) setting of the display device.

4. The pixel circuit of claim 1, wherein during the first phase, the first terminal (S) of the drive transistor is set to the fixed data voltage such that the drive transistor is stressed with a fixed gate-to-source voltage to prevent a drift of a threshold voltage in the drive transistor thereby preventing a drift in screen brightness of the display device.

5. A pixel circuit for a display device, the pixel circuit comprising:

a drive transistor configured to control an amount of current to a light-emitting device during an emission phase depending upon a voltage applied to a control terminal of the drive transistor, the drive transistor having a first terminal and a second terminal;

wherein, during a first phase having a fixed duration, an anode of the light emitting device is set to a reference voltage and the first terminal of the drive transistor is set to a fixed data voltage such that the drive transistor is stressed with a fixed source-to-gate voltage to prevent a drift of a threshold voltage in the drive transistor thereby preventing a drift in screen brightness of the display device; and wherein, during a second phase having a variable duration, the anode of the light emitting device is set to the reference voltage and the first terminal of the drive transistor is set to a voltage of the first power supply.

6. The pixel circuit of claim 5, further comprising a switch transistor connected between the reference voltage and the control of the drive transistor.

7. The pixel circuit of claim 5, further comprising a switch transistor connected between the second terminal and the control terminal of the drive transistor.

8. The pixel circuit of claim 5, further comprising a switch transistor connected between a first power supply and the first terminal of the drive transistor.

9. The pixel circuit of claim 5, further comprising a switch transistor connected between a data line and the first terminal of the drive transistor.

10. The pixel circuit of claim 5, further comprising a switch transistor connected between the second terminal of the drive transistor and an anode of the light emitting device.

11. The pixel circuit of claim 5, further comprising a switch transistor connected between the anode of the light emitting device and the reference voltage.

12. The pixel circuit of claim 5, wherein:

during the first phase, a first emission pulse having a constant pulse width is applied to a control terminal of a sixth transistor to set the anode of the light emitting device to the reference voltage; and during the first phase, a scan pulse is applied to a control terminal of a fourth transistor to set the first terminal of the drive transistor to the fixed data voltage.

13. The pixel circuit of claim 5, wherein:

during the second phase, a second emission pulse having a variable pulse width is applied to a control terminal of a sixth transistor to set the anode of the light emitting device to the reference voltage, and to control a pulse width modulation (PWM) setting of the display device.

14. A method of operating a pixel circuit for a display device, the method comprising:

providing the pixel circuit comprising:

a drive transistor configured to control an amount of current to a light-emitting device during an emission phase depending upon a voltage applied to a control terminal of the drive transistor, the drive transistor having a first terminal and a second terminal;

a first transistor connected between a reference voltage and the control of the drive transistor;

a second switch transistor connected between the second terminal and the control terminal of the drive transistor;

a third switch transistor connected between a first power supply and the first terminal of the drive transistor;

a fourth switch transistor connected between a data line and the first terminal of the drive transistor;

a fifth switch transistor connected between the second terminal of the drive transistor and an anode of the light emitting device; and a sixth switch transistor connected between the anode of the light emitting device and the reference voltage;

performing a first phase having a fixed duration, during which the anode of the light emitting device is set to the reference voltage and the first terminal of the drive transistor is set to a fixed data voltage; and performing a second phase having a variable duration, during which the anode of the light emitting device is set to the reference voltage and the first terminal of the drive transistor is set to a voltage of the first power supply.

15. The method of claim 14, wherein the first phase is an anode reset and on bias stress phase.

16. The method of claim 15, wherein:

during the anode reset and on bias stress phase, a first emission pulse having a constant pulse width is applied to a control terminal of the sixth transistor to set the anode of the light emitting device to the reference voltage; and during the anode reset and on bias stress phase, a scan pulse is applied to a control terminal of the fourth transistor to set the first terminal of the drive transistor to the fixed data voltage.

17. The method of claim 14, wherein the second phase is an anode reset only phase.

18. The method of claim 17, wherein, during the anode reset only phase, a second emission pulse having a variable pulse width is applied to a control terminal of the sixth transistor to set the anode of the light emitting device to the reference voltage, and to control a pulse width modulation (PWM) setting of the display device.

19. The method of claim 14, wherein, during the first phase, the first terminal (S) of the drive transistor is set to a fixed data voltage such that the drive transistor is stressed with a fixed gate-to-source voltage to prevent a drift of a threshold voltage in the drive transistor to prevent a drift in screen brightness of the display device.

* * * * *